United States Patent [19]

Oberholtzer

[11] Patent Number: 4,738,280

[45] **Date of Patent: * Apr. 19, 1988**

[54] HOT WATER SUPPLY SYSTEM

[76] Inventor: Steven L. Oberholtzer, 131 E. Lovell, Troy, Mich. 48098

[ * ] Notice: The portion of the term of this patent subsequent to Mar. 10, 2004 has been disclaimed.

[21] Appl. No.: 23,200

[22] Filed: Mar. 9, 1987

Related U.S. Application Data

[63] Continuation-in-part of Ser. No. 746,879, Jun. 20, 1985, Pat. No. 4,648,426.

[51] Int. Cl.[4] ..... F24H 1/00

[52] U.S. Cl. ..... 137/603; 137/625.41; 126/362

[58] Field of Search ..... 126/362; 237/56, 19; 137/801, 602, 603, 896, 561 R, 625.41, 625.46

[56] References Cited

U.S. PATENT DOCUMENTS

| | | | |
|---|---|---|---|
| 1,115,139 | 10/1914 | Wilkes et al. . | |
| 1,969,460 | 8/1934 | Glenn . | |
| 2,255,460 | 9/1941 | Weaver . | |
| 2,515,974 | 7/1950 | Araldsen . | |
| 2,842,155 | 7/1958 | Peters . | |
| 2,975,802 | 3/1961 | Turak . | |
| 3,776,261 | 12/1973 | Houghton . | |
| 4,450,829 | 5/1984 | Morita et al. | 126/362 |
| 4,648,426 | 3/1987 | Oberholtzer | 126/362 |

*Primary Examiner*—Henry A. Bennet

*Attorney, Agent, or Firm*—Harness, Dickey & Pierce

[57] ABSTRACT

An improved hot water supply system is disclosed which provides hot water from a faucet without requiring water flow for a prolonged period of time necessary to displace water retained within connecting pipe. A significant reduction in the time delay before hot water becomes available is achieved by employing a pair of hot water supply pipes connected to a valve or a flow controller. One of the pipes has an internal diameter which is less than that necessary to provide the maximum flow rate capacity requirement of the outlet. This small diameter pipe, termed the auxiliary pipe, is used to provide hot water when the valve is set at a low flow rate setting and due to its small retained volume, provides hot water quickly. A high flow rate setting, water flow through both a primary and auxiliary pipe is permitted, thereby enabling water to be discharged at the desired maximum flow rate various embodiments disclose alternate means for employing several hot water supply pipes.

3 Claims, 1 Drawing Sheet

HOT WATER SUPPLY SYSTEM

CROSS REFERENCE TO RELATED APPLICATIONS

This application is a continuation-in-part of copending application Ser. No. 746,879 filed June 20, 1985, now U.S. Pat. No. 4,648,426 entitled "Improved Hot Water Supply System" the disclosure of which is hereby incorporated by reference.

BACKGROUND AND SUMMARY OF THE INVENTION

This invention relates to an improved hot water supply system and particularly to such systems useful in residential and commercial structures in which hot water is demanded at a particular discharge point on an intermittent basis.

An age-old problem with hot water supply systems has been the necessity for the user to open the hot water valve and permit water to flow from the faucet or nozzle for a considerable period of time before hot water becomes available. This problem exists since the hot water source such as a water heater or boiler is typically located remotely from the point of discharge and is connected between these points by a long supply pipe. Hot water within the supply pipe loses its heat to the surrounding environment rapidly once the flow of water therethrough is stopped or significantly reduced. Once the water in the supply pipe has dissipated its heat, the hot water discharge valve must be opened to permit the water to flow until the cooled water is completely displaced from the connecting pipe. This requirement results in a significant inconvenience to the user and is also highly inefficient from an energy conservation perspective since every use results in the entire connecting pipe being filled with hot water which becomes cooled after the demand is fulfilled.

In many instances, a delay in availability of hot water is not objectionable. However, where the user desires a small quantity of hot water, for example, for hand and face washing in a home bathroom, such a delay constitutes an inconvenience and a significant waste of energy since the user only requires a few pints or gallons of hot water and yet the entire volume of the connecting supply pipe must be displaced with hot water before such a small quantity becomes available.

Numerous attempts have been made to address the problems of providing hot water quickly and overcoming the inherent inefficiencies of present day hot water supply systems. According to one approach, the hot water supply pipes are encased by a jacket of thermal insulating material. The use of insulation does prevent rapid loss of heat from heated water in supply pipes so that, if hot water is demanded soon after an initial demand, hot water will be immediately available. This approach, however, has the drawback that, following a sufficiently prolonged period of time, heat from the supply pipe will eventually be dissipated to the cooler surrounding environment necessitating the displacement of this cooled water before hot water can be discharged. In many usage conditions, there may be substantial lapses of time between demands for hot water, and therefore, this approach does not overcome the above-described shortcomings of present day hot water supply systems.

Another approach toward addressing the shortcomings of present hot water supply systems is the use of so-called point of source water heaters. These electrically or gas fired water heaters are located close to the point of hot water discharge. These devices rapidly heat water from a supply pipe to provide nearly instantaneous hot water. These heaters, however, suffer the disadvantages that they are costly, complicated, bulky, and generally require a significant amount of labor for installation.

A further method of addressing the above-mentioned problems is to locate the hot water heater or boiler as close as practicable to the desired point of hot water discharge, thereby minimizing the amount of water which must be displaced within a connecting supply pipe before hot water becomes available. This approach is unsatisfactory, however, where multiple points of hot water discharge are desired, such as in a typical home where several bathrooms or sinks may be located at various remote locations. In such situations, this method of overcoming the problems of present hot water supply systems is useful only for certain of the multiple hot water discharge locations. Moreover, the design of a particular structure may impose constraints on the placement of the water heater or boiler such that the use of long connecting pipes cannot be avoided.

Yet another approach toward minimizing the above-mentioned shortcomings is to employ a pipe between a hot water source and the point of discharge which is as short as possible and which has as small a diameter as possible, thereby minimizing the total retained volume of water which must be displaced in order to provide hot water once the retained water has cooled. This method, however, has limitations in that the diameter of the connecting pipe is primarily dictated by the maximum flow rate requirements of the system. For example, many hot water supply systems are used to provide a full residential bathroom including a sink and shower with hot water. This pipe connecting the hot water source with such a bathroom must have a sufficient flow rate capacity to supply the shower and sink during use. In such applications, the use of a small diameter hot water supply pipe would provide hot water more rapidly, but would be unable to fulfill the maximum flow rate requirements of the system.

In view of the above, it is an object of this invention to provide an improved hot water supply system which provides hot water quickly and with high efficiency. It is a further object of this invention to provide such a hot water supply system inexpensively and without complex apparatus. It is an additional object of this invention to provide an improved hot water supply system which is readily adaptable for use with existing hot water supply systems.

The above principal objects of this invention are achieved by providing a hot water supply system which employs a pair of pipes which connects the source of hot water with the point of hot water discharge. Valve means are employed which permit water flow only through one of the pipes, termed an auxiliary pipe, in situations wherein a small quantity of hot water is desired. When high flow rates of hot water are required, the valve permits flow through both the auxiliary and primary hot water pipe. The auxiliary pipe has a smaller diameter than is dictated by the maximum flow rate requirements of the outlet and therefore has a lower retained volume which is quickly displaced, enabling hot water to be available without a long delay. When high volumes of water are required, the valve means permits flow through the primary pipe to fulfill the maximum flow rate requirements for the particular point of discharge. In situations where only a small volume of hot water is demanded, water flows only through the auxiliary pipe and, due to its small cross-sectional area, it retains a smaller volume of hot water, and therefore less energy is lost when the heat retained by this water is dissipated to the environment during prolonged periods wherein the flow rate within the pipe is zero or minimal.

Several embodiments utilizing the above-mentioned approach toward providing an improved hot water supply system are described in detail in the above referenced related patent application. This particular disclosure is related to a number of improvements and alternate embodiments for the systems described in the above referenced application. In accordance with the present invention, an automatic valve means is described which senses the flow rate being demanded at the water discharge outlet and automatically switches between the auxiliary and primary water supply pipes in accordance with the discharge rate being demanded. This valve means may be in the form of a pressure reducing valve within the primary pipe flow which permits flow therethrough when the pressure in the auxiliary pipe falls below the predetermined level. Accordingly, once the user is demanding a flow rate which exceeds the capability of the auxiliary pipe, the flow is automatically augmented by the primary supply pipe. The present disclosure further describes a flow pulser which may be placed in the primary water supply line to provide an indication to the user that the flow through the primary pipe is occurring. When used with a manual valve such as described in the above-referred application, the flow pulser enables the user to allow flow only through the auxiliary pipe, or both pipes, as desired. In those situations where residential water pressure is extremely low such that an adequate flow rate through the auxiliary water pipe cannot be provided, this invention teaches the use of an in-line water pump which would aid in providing such flow.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
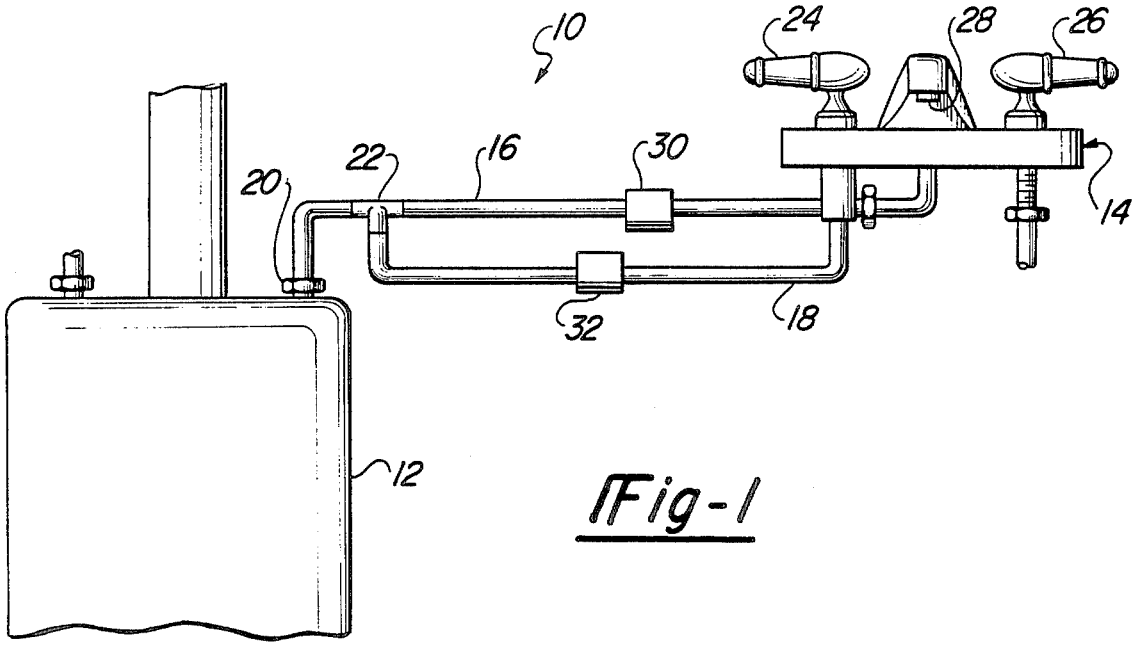
FIG. 1 is a pictorial view of a hot water supply system in accordance with the first embodiment of this invention showing the use of an in-line water pump in the auxiliary pipe and a flow pulser within the primary pipe.

A hot water supply system according to a first embodiment of this invention is shown in FIG. 1 and is generally designated by reference number 10. Hot water supply system 10 includes water heater 12 and faucet assembly 14, with a pair of pipes 16 and 18 connected therebetween. Primary supply pipe 16 would be typically a rigid thin-wall copper or iron pipe directly connected between hot water discharge nipple 20 of water heater 12 and faucet assembly 14. Auxiliary pipe 18 preferably has a diameter less than that of pipe 16 and can be attached directly to nipple 20 or to T-fitting 22 which is located close to nipple 20. Auxiliary pipe 18 may, for example, be of the thin wall flexible copper of PVC plastic variety which are typically purchased in coiled rolls and which are easily bent by the installer to run from the source of hot water to faucet assembly 14 without the necessity of employing elbows, angle joints, and other fittings.

Faucet assembly 14 includes hot water valve 24 and cold water valve 26. Both valves 24 and 26 control the flow of water through faucet outlet 28. Cold water valve 26 is employed to control the flow of water from faucet outlet 28 and is connected to any source of cold water (not shown).

As explained in detail in the above referenced related applications, hot water valve 24 is designed to control the flow of water through both pipes 16 and 18, in a predetermined manner. In operation, when the user desires to discharge a small quantity of hot water from faucet outlet 28, hot water valve 24 is rotated to an intermediate position which permits flow only through auxiliary pipe 18. A detent (not shown) may be provided to provide a tactile or audible indication to the user that this initial position has been reached. Due to the relatively small diameter of pipe 18, for example, one-quarter inch internal diameter, the total retained volume within pipe 18 is small and therefore water therein which may have dissipated its heat due to a prolonged exposure to the environment becomes quickly displaced with hot water from water heater 12. If, however, the user desires to discharge hot water at a high discharge rate, then hot water valve 24 is rotated counterclockwise from its initial position above such that the flow through both pipe 16 and 18 occurs.

FIG. 1 illustrates the provision of several optional devices installed within which may used separately or in combination, as shown in FIG. 1. Flow pulser 30 is a fluidically driven pulsing device which provides an intermittent or "chopped" water output. The use of flow pulser 30 results in pulsed flow through faucet outlet 28 when flow is occurring through primary pipe 16. Such pulsed flow provides an obvious indication to the user of the position at which hot water valve 24 is set. Accordingly, if the user desires to permit flow only through auxiliary pipe 18, hot water valve 24 may be rotated up to the point where the pulsing becomes less noticeable, indicating that flow has begun through primary pipe 16.

In some installations it may be difficult to provide sufficient flow rate through auxiliary pipe 18 due to inadequate water supply pressure or excessive restriction within the auxiliary pipe due to its length or small diameter. Accordingly, it may be desirable in certain instances to provide in-line water pump 32 within auxiliary pipe 18. Water pump 32 is preferable electrically powered and would include switching means to control its operation. Pump 32 may have an internal switching element which senses water flow (or pressure) to automatically activate the pump once flow through auxiliary pipe 18 occurs. Alternately, a pressure switch may be used which taps into auxiliary pipe 18 and senses when the pressure therein drops, indicating that hot water valve 24 has been opened and pump 32 is required to enhance flow through the auxiliary pipe. Pump 32 may also be used to boost flow through auxiliary pipe 18 to the extent that primary pipe 16 can be eliminated entirely. For such an embodiment, pump 32 could be activated whenever valve 24 is opened or when it is opened beyond a specified position.

Figure 2:
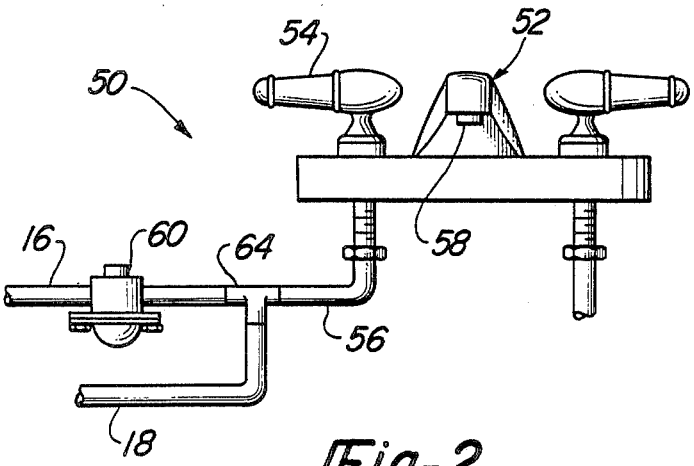
FIG. 2 is a pictorial view of a hot water system in accordance with the second embodiment of this invention illustrating the use of a pressure reducing valve within the primary pipe as a means of automatically controlling flow therethrough to the point of discharge.

FIG. 2 illustrates a second embodiment of a hot water system according to this invention. This embodiment provides the advantages of a dual supply hot water system employing primary and auxiliary pipes 16 and 18, but does not require the provision of a specially designed faucet assembly such as previously described in connection with the first embodiment. Hot water system 50 uses an existing faucet assembly 52 of a conventional design. Hot water system 50 includes means for automatically controlling the flow of water through pipes 16 and 18 in accordance with the flow rate being demanded by the user. Faucet assembly 52 includes hot water valve 54 which controls the flow of hot water through feed pipe 56 for discharge through faucet outlet 58. Pressure reducing valve 60 is provided within primary pipe 16 and acts as a pressure regulator such that flow through primary pipe 16 only occurs if the hydrostatic pressure within feed pipe 56 falls below a predetermined level. Feed pipe 56 communicates with tee fitting 64 through which the water flowing in auxiliary pipe 18 flows.

In operation, when hot water valve 54 is partially opened, flow through auxiliary pipe 18 occurs since it directly communicates with the valve. If the flow of water through auxiliary pipe 18 is in a relatively low flow rate, the hydrostatic pressure of the water therein will not fall to an extremely low level at or near the point of discharge through faucet assembly 52. In this situation, no flow occurs through pressure reading valve 60. If, however, hot water valve 54 is fully opened, the hydrostatic pressure in feed pipe 56 and tee fitting 64 will fall to a low level, for example, 3–5 psi. Once this low pressure level is achieved, pressure reducing valve 60 will open to permit flow to occur through primary pipe 16. Accordingly, the use of pressure reducing valve 60 serves to automatically control the flow of water through primary pipe 16 such that it is provided only when auxiliary pipe 18 cannot provide a sufficient flow rate. If a flow pulser such as described in conjunction with the first embodiment is used, the user is provided with an indication of the threshold at which pressure reducing valve 60 opens.

While the above description constitutes the preferred embodiments of the present invention, it will be appreciated that the invention is susceptible to modification, variation and change without departing from the proper scope and fair meaning of the accompanying claims.

What is claimed:

1. A hot water supply system adapted to provide hot water at a given maximum flow rate, comprising:

hot water supply means, a water discharge outlet, an auxiliary water supply pipe connecting said discharge outlet with said hot water supply means, said auxiliary pipe having an internal diameter smaller than that necessary to provide water flow at said maximum flow rate whereby means are provided for minimizing the volume of water retained by said auxiliary pipe, a primary water supply pipe connecting said discharge outlet with said hot water supply means, valve means for controlling water flow through said auxiliary and said primary water supply pipes, said valve means permitting water flow only through said auxiliary pipe at a first setting of said valve means whereby hot water rapidly displaces water in said retained volume of said auxiliary pipe and therefore becoming quickly available at said discharge outlet, said valve means permitting flow through said primary pipe at a second setting of said valve means to provide water at said maximum flow rate, and flow pulser means within said primary water supply pipe for providing an indication to a user that said valve means is providing flow through said primary water supply pipe to said water discharge outlet.

2. A hot water supply system adapted to provide hot water at a given maximum flow rate, comprising:

hot water supply means, a water discharge outlet, an auxiliary water supply pipe connecting said discharge outlet with said hot water supply means, said auxiliary pipe having an internal diameter smaller than that necessary to provide water flow at said maximum flow rate whereby means are provided for minimizing the volume of water retained by said auxiliary pipe, a primary water supply pipe connecting said discharge outlet with said hot water supply means, valve means for controlling water flow through said auxiliary and said primary water supply pipes, said valve means permitting water flow only through said auxiliary pipe at a first setting of said valve means whereby hot water rapidly displaces water in said retained volume of said auxiliary pipe and therefore becoming quickly available at said discharge outlet, said valve means permitting flow through said primary pipe at a second setting of said valve means to provide water at said maximum flow rate, and pump means for enhancing the flow of water through said auxiliary water supply pipe.

3. A hot water supply system adapted to provide hot water at a given maximum flow rate, comprising:

hot water supply means, a water discharge outlet, an auxiliary water supply pipe connecting said discharge outlet with said hot water supply means, said auxiliary pipe having an internal diameter smaller than that necessary to provide water flow at said maximum flow rate whereby means are provided for minimizing the volume of water retained by said auxiliary pipe, a primary water supply pipe connecting said discharge outlet with said hot water supply means, a pressure reducing valve biasing an inlet connected to said primary water supply pipe and an outlet connected to a feed pipe, said pressure reducing valve permitting flow therethrough when the pressure in said feed pipe falls below a predetermined pressure, and a manual valve connected to said feed pipe for controlling the flow of water through said water discharge outlet, said auxiliary pipe being connected to said feed pipe such that when said manual valve is opened within a first range, the pressure in said feed pipe does not fall below said predetermined pressure and flow occurs only through said auxiliary pipe, whereby hot water rapidly displaces water in said auxiliary pipe and therefore becomes quickly available at said discharge outlet, and when said manual valve is opened to a second range, the pressure in said feed pipe approaches said predetermined pressure causing said pressure reducing valve to open such that water flows through both said auxiliary and said primary water supply pipes.

* * * * *